US010752858B2

(12) United States Patent
Lerasle et al.

(10) Patent No.: US 10,752,858 B2
(45) Date of Patent: Aug. 25, 2020

(54) LUBRICANT COMPOSITION

(71) Applicant: TOTAL MARKETING SERVICES, Puteaux (FR)

(72) Inventors: Olivier Lerasle, Paris (FR); Jérôme Valade, Paris (FR); Mickaël Debord, Saint-Genis-Laval (FR)

(73) Assignee: Total Marketing Services, Puteaux (FR)

( * ) Notice: Subject to any disclaimer, the term of this patent is extended or adjusted under 35 U.S.C. 154(b) by 26 days.

(21) Appl. No.: 14/442,582

(22) PCT Filed: Nov. 15, 2013

(86) PCT No.: PCT/EP2013/073951
§ 371 (c)(1),
(2) Date: May 13, 2015

(87) PCT Pub. No.: WO2014/076240
PCT Pub. Date: May 22, 2014

(65) Prior Publication Data

US 2016/0130521 A1 May 12, 2016

(30) Foreign Application Priority Data

Nov. 16, 2012 (FR) ..... 12 60933

(51) Int. Cl.
*C10M 163/00* (2006.01)
*C10M 139/00* (2006.01)
*C10M 141/10* (2006.01)

(52) U.S. Cl.
CPC ..... *C10M 139/00* (2013.01); *C10M 141/10* (2013.01); *C10M 2203/1025* (2013.01); *C10M 2205/04* (2013.01); *C10M 2207/26* (2013.01); *C10M 2209/084* (2013.01); *C10M 2215/064* (2013.01); *C10M 2219/046* (2013.01); *C10M 2219/068* (2013.01); *C10M 2223/045* (2013.01); *C10N 2210/02* (2013.01); *C10N 2210/06* (2013.01); *C10N 2230/06* (2013.01); *C10N 2230/54* (2013.01); *C10N 2230/70* (2013.01); *C10N 2240/10* (2013.01)

(58) Field of Classification Search
CPC ..... C10M 137/06; C10M 2201/062; C10M 159/22; C10M 137/02
USPC ..... 508/363, 364
See application file for complete search history.

(56) References Cited

U.S. PATENT DOCUMENTS 4,072,619 A 2/1978 Williams et al.
5,627,146 A 5/1997 Tanaka et al.
5,707,942 A * 1/1998 Arai ..... C10M 141/12 508/365
6,110,878 A 8/2000 McConnachie et al.
6,458,750 B1 10/2002 Dardin et al.
7,402,800 B2 7/2008 Delvigne et al.
7,662,881 B2 2/2010 Walton et al.
8,334,245 B2 12/2012 Lancon et al.
8,357,644 B2 1/2013 Thoen et al.
8,486,878 B2 7/2013 Li Pi Shan et al.
8,492,322 B2 7/2013 Li Pi Shan et al.
8,592,357 B2 11/2013 Thoen et al.
8,609,597 B2 12/2013 Greaves et al.
8,664,169 B2 3/2014 Bouffet
9,957,462 B2 5/2018 Guerin et al.
2003/0022954 A1 1/2003 Masawaki
2005/0107269 A1 5/2005 Yagishita et al.
2006/0116298 A1* 6/2006 Chambard ..... C10M 163/00 508/287
2009/0093384 A1 4/2009 Ward et al.
2009/0163392 A1* 6/2009 Boffa ..... C10M 141/10 508/161
2009/0203561 A1 8/2009 Kamano
2010/0041572 A1* 2/2010 Sano ..... C10M 101/02 508/382
2010/0075875 A1 3/2010 Yaguchi
2011/0059877 A1 3/2011 Obiols et al.
2011/0098204 A1 4/2011 Patil et al.
2011/0306527 A1 12/2011 Bouffet et al.
2012/0108482 A1 5/2012 Greaves et al.
2012/0184473 A1 7/2012 Boffa et al.
2012/0264666 A1* 10/2012 Donnelly ..... C10M 135/18 508/363
2013/0096041 A1 4/2013 Matray et al.
2013/0157909 A1 6/2013 Greaves et al.
2013/0178402 A1 7/2013 Chauveau et al.
2013/0244917 A1 9/2013 Obrecht et al.
2013/0281331 A1 10/2013 Bardin
2014/0018272 A1 1/2014 Thoea et al.
2014/0018273 A1 1/2014 Zweifel et al.
2014/0235516 A1 8/2014 Lancon
(Continued)

FOREIGN PATENT DOCUMENTS

CA 2034144 A1 7/1991
EP 0438709 A1 7/1991
(Continued)

OTHER PUBLICATIONS

Rounds, Fred; "Effects of Organic Molybdenum Compounds on the Friction and Wear Observed with ZDP-Containing Lubricant Blends"; Tribology Transactions, vol. 33, No. 2, Presented at the 35th STLE/ASME Tribology Conference in Fort Lauderdale, Florida, XP007916401, Oct. 16-19, 1989; pp. 345-354.
(Continued)

*Primary Examiner* — Prem C Singh
*Assistant Examiner* — Francis C Campanell
(74) *Attorney, Agent, or Firm* — Harness, Dickey & Pierce, PLC

(57) ABSTRACT

A lubricant composition has a high molybdenum content and includes a combination of at least two compounds including molybdenum.

24 Claims, No Drawings

(56) References Cited

U.S. PATENT DOCUMENTS

| | | | |
|---|---|---|---|
| 2015/0119303 | A1 | 4/2015 | Guerin et al. |
| 2015/0126419 | A1 | 5/2015 | Lerasle et al. |

FOREIGN PATENT DOCUMENTS

| | | | |
|---|---|---|---|
| EP | 0719851 | A2 | 7/1996 |
| EP | 0743354 | A1 | 11/1996 |
| EP | 0757093 | A1 | 2/1997 |
| EP | 1013749 | A2 | 6/2000 |
| EP | 0822246 | B1 | 10/2000 |
| EP | 2078745 | A1 | 7/2009 |
| JP | S54159411 | A | 12/1979 |
| JP | S6088094 | A | 5/1985 |
| JP | H093463 | A | 1/1997 |
| JP | 2011057759 | A | 3/2011 |
| WO | WO-9826030 | A1 | 6/1998 |
| WO | WO-03008428 | A1 | 1/2003 |
| WO | WO-2005113640 | A1 | 12/2005 |
| WO | WO-2007096719 | A1 | 8/2007 |
| WO | WO-2009134716 | A1 | 11/2009 |
| WO | WO-2010046620 | A1 | 4/2010 |
| WO | WO-2010114209 | A1 | 10/2010 |
| WO | WO-2011011656 | A2 | 1/2011 |
| WO | WO-2012030537 | A1 | 3/2012 |
| WO | WO-2012040174 | A1 | 3/2012 |
| WO | WO-2012070007 | A1 | 5/2012 |

OTHER PUBLICATIONS

Office Action dated Jul. 4, 2017 by the Japanese Patent Office for Japanese Patent Application No. 2015-542275, and an English Translation of the Office Action (5 pages).

"UCON™ OSP Base Fluids" Brochure, DOW, XP055034465, Feb. 28, 2011; 4 pages.

* cited by examiner

LUBRICANT COMPOSITION

CROSS-REFERENCE TO RELATED APPLICATIONS

This application is a National Phase Entry of International Application No. PCT/EP2013/073951, filed on Nov. 15, 2013, which claims priority to French Patent Application Serial No. 1260933, filed on Nov. 16, 2012, both of which are incorporated by reference herein.

BACKGROUND AND SUMMARY

The present invention relates to the field of lubricants. More particularly, the present invention relates to a lubricant composition with a high molybdenum content and comprising a combination of at least two compounds comprising molybdenum of a different chemical type. The lubricant composition according to the invention simultaneously has good fuel economy properties and good stability properties on storage. The present invention also relates to a method for the lubrication of a mechanical part. The present invention relates to a method for reducing energy losses by friction of a mechanical part. The use of a lubricant composition for reducing fuel consumption is also another subject of the present invention.

The worldwide spread of the automobile since the end of the last century poses problems regarding global warming, pollution, the security and use of natural resources, in particular to the depletion of oil reserves. Following the establishment of the Kyoto protocol, new standards protecting the environment required the automobile industry to construct vehicles having reduced pollutant emissions and fuel consumption. As a result, the engines of these vehicles are subject to increasingly strict technical restrictions: in particular they run faster, at increasingly high temperatures and must consume increasingly less fuel. The nature of engine lubricants for automobiles has an influence on the emission of pollutants and on fuel consumption. Engine lubricants for automobile engines, called energy-saving or "fuel-eco", have been developed in order to meet these new requirements.

The improvement in the energy performance of lubricant compositions can be obtained in particular by mixing specific additives such as friction modifiers, polymers that improve the viscosity index into base oils. Among the friction modifiers, the organometallic compounds comprising molybdenum are commonly used. A sufficient quantity of molybdenum must be present for a lubricant composition to have good anti-friction properties. Among these organometallic compounds, molybdenum dialkylthiocarbamate (referred to in the rest of the present application by the acronym Mo-DTC) is most often used as a source of molybdenum. However, this compound has the drawback of causing the formation of sediments when the lubricant composition has a too high content of elemental molybdenum. The poor solubility of this compound modifies, or even degrades the properties of the lubricant composition, in particular its viscosity. Now, a composition which is too viscous or not viscous enough militates against the movement of the mobile parts, easy starting of an engine, the protection of an engine when it has reached its operating temperature, and therefore ultimately causes in particular an increase in fuel consumption.

Different attempts at solubilizing Mo-DTC in lubricant compositions have been tested. The use of asymmetrical Mo-DTC compounds, i.e. obtained from dialkylamines having hydrocarbon-containing groups of different sizes is known from the document EP0719851. These asymmetrical compounds, in particular in combination with Mo-DTP compounds, make it possible to improve the solubility of the molybdenum, in particular originating from the Mo-DTC, in lubricant compositions having a high viscosity index (VI).

The document EP 0 757 093 describes lubricant compositions which can comprise Mo-DTC and/or Mo-DTP. However, this document teaches that a quantity of molybdenum which exceeds 700 ppm provided by the Mo-DTC and the Mo-DTP can result in the appearance of problems of stability of the composition, thus leading a person skilled in the art away from formulating lubricant compositions with a high molybdenum content.

As fuel economy demands are increasing, a need still exists to formulate a lubricant composition having a high molybdenum content and simultaneously having storage stability and improved fuel economy properties. By "high molybdenum content" is meant within the meaning of the present invention, lubricant compositions having a total mass of molybdenum of at least 1000 ppm (ppm=parts per million) with respect to the total mass of the lubricant composition.

An objective of the present invention is to supply a lubricant composition overcoming all or part of the aforementioned drawbacks. Another objective of the invention is to supply a lubricant composition the formulation of which is easy to implement. Another objective of the present invention is to supply a lubrication method allowing energy savings. Thus, a subject of the invention is a lubricant composition comprising at least one base oil, at least one molybdenum dithiocarbamate (Mo-DTC) compound, at least one molybdenum dithiophosphate (Mo-DTP) compound and in which the quantity of molybdenum provided by the Mo-DTP compound and the Mo-DTC compound ranges from 1000 to 2500 ppm by mass with respect to the total mass of the lubricant composition and in which the quantity of molybdenum provided by Mo-DTC compound is strictly less than 900 ppm by mass with respect to the total mass of the lubricant composition.

By "lubricant composition" within the meaning of the present invention, is meant a lubricant composition, and not a grease. In fact in greases, the additives are not solubilized but dispersed in the network of fibres formed by the soap. The problem of solubility of the Mo-DTC does not arise as it does in particular in motor oils, in which solubility is essential. Thus, the lubricant compositions according to the invention are not greases.

Surprisingly, the applicant company has observed that, in a lubricant composition having a molybdenum content which ranges from 1000 to 2500 ppm and comprising an Mo-DTC compound, the addition of at least one Mo-DTP compound makes it possible to solubilize the Mo-DTC compound and simultaneously makes it possible to improve the fuel saving properties of said composition. However, the quantity of Mo provided by the Mo-DTC compound must be strictly less than 900 ppm in the lubricant composition with respect to the total mass of the lubricant composition. Thus, the present invention makes it possible to formulate lubricant compositions with a high molybdenum content and in which the Mo-DTC compounds are soluble, i.e. they can be dissolved in the lubricant composition without forming a precipitate or without making it cloudy.

Advantageously, the Mo-DTC compounds are soluble in a lubricant composition the temperature of which varies from 0° C. to 200° C., preferably from 10° C. to 150° C., more preferentially from 20° C. to 100° C., yet more preferentially from 40° C. to 80° C. Advantageously, the lubricant compositions according to the invention have a better storage stability, in particular for storage at a temperature of 0° C. Advantageously, the combination of at least one Mo-DTC compound and at least one Mo-DTP compound in a lubricant composition comprising a high molybdenum content allows fuel savings to be made when an engine is idling or running at high speed. In an embodiment, the lubricant composition essentially consists of at least one base oil, at least one Mo-DTC compound, at least one Mo-DTP compound and in which the quantity of molybdenum provided by the Mo-DTP compound and the Mo-DTC compound ranges from 1000 to 2500 ppm by mass with respect to the total mass of the lubricant composition and in which the quantity of molybdenum provided by the Mo-DTC compound is strictly less than 900 ppm by mass with respect to the total mass of the lubricant composition.

DETAILED DESCRIPTION

Molybdenum Dithiocarbamate Compound

The molybdenum dithiocarbamate compounds (Mo-DTC compound) are complexes formed from a metal nucleus bonded to one or more ligands, the ligand being an alkyl dithiocarbamate group. These compounds are well known to a person skilled in the art.

In an embodiment, the Mo-DTC compound used in the compositions according to the invention can comprise from 1 to 40%, preferably from 2 to 30%, more preferentially from 3 to 28%, yet more preferentially from 4 to 15% by mass of molybdenum, with respect to the total mass of the Mo-DTC compound. In an embodiment, the Mo-DTC compound used in the compositions according to the invention can comprise from 1 to 40%, preferably from 2 to 30%, more preferentially from 3 to 28%, yet more preferentially from 4 to 15% by mass of sulphur, with respect to the total mass of the Mo-DTC compound. Mo-DTC compound used in the present invention can be chosen from those in which the nucleus has two molybdenum atoms (also called dimeric Mo-DTC) and those in which the nucleus has three molybdenum atoms (also called trimeric Mo-DTC).

The trimeric Mo-DTC compounds correspond to the formula $Mo_3S_kL_n$ in which:

k represents an integer at least equal to 4, preferably ranging from 4 to 10, advantageously from 4 to 7, n is an integer ranging from 1 to 4, and L being an alkyl dithiocarbamate group comprising from 1 to 100 carbon atoms, preferably from 1 to 40 carbon atoms, advantageously from 3 to 20 carbon atoms.

As examples of trimeric Mo-DTC compounds, the compounds and the preparation processes thereof as described in the documents WO 98/26030 and US 2003/022954 can be mentioned. Preferably, the Mo-DTC compound used in the lubricant composition according to the invention is a dimeric Mo-DTC compound. As examples of dimeric Mo-DTC compounds, the compounds and the preparation processes thereof as described in the documents EP 0 757 093, EP 0 719 851, EP 0 743 354 or EP 1 013 749 can be mentioned.

The dimeric Mo-DTC compounds generally correspond to the compounds of formula (A):

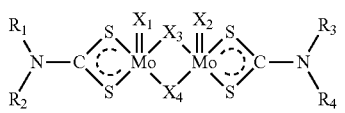

(A)

in which:

$R_1$, $R_2$, $R_3$, $R_4$, identical or different, independently represent a hydrocarbon-containing group chosen from the alkyl, alkenyl, aryl, cycloalkyl or cycloalkenyl groups, $X_1$, $X_2$, $X_3$ and $X_4$, identical or different, independently represent an oxygen atom or a sulphur atom.

By alkyl group within the meaning of the invention, is meant a linear or branched, hydrocarbon-containing group, comprising from 1 to 24 carbon atoms. In an embodiment, the alkyl group is chosen from the group formed by methyl, ethyl, propyl, isopropyl, n-butyl, iso-butyl, tert-butyl, n-pentyl, iso-pentyl, neopentyl, hexyl, heptyl, octyl, nonyl, decyl, undecyl, dodecyl, tridecyl, isotridecyl, tetradecyl, hexadecyl, stearyl, icosyl, docosyl, tetracosyl, triacontyl, 2-ethylhexyl, 2-butyloctyl, 2-butyldecyl, 2-hexyloctyl, 2-hexyldecyl, 2-octyldecyl, 2-hexyldodecyl, 2-octyldodecyl, 2-decyltetradecyl, 2-dodecylhexadecyl, 2-hexadecyloctadecyl, 2-tetradecyloctadecyl, myristyl, palmityl and stearyl.

By alkenyl group within the meaning of the present invention, is meant a linear or branched hydrocarbon-containing group comprising at least one double bond and comprising from 2 to 24 carbon atoms. The alkenyl group can be chosen from vinyl, allyl, propenyl, butenyl, isobutenyl, pentenyl, isopentenyl, hexenyl, heptenyl, octenyl, nonenyl, decenyl, undecenyl, dodecenyl, tetradecenyl, oleic.

By aryl group within the meaning of the present invention, is meant a polycyclic aromatic hydrocarbon or an aromatic group which is substituted or not substituted by an alkyl group. The aryl group comprises from 6 to 24 carbon atoms. The aryl group can be for example phenyl, toluyl, xylyl, cumenyl, mesityl, benzyl, phenethyl, styryl, cinnamyl, benzhydryl, trityl, ethylphenyl, propylphenyl, butylphenyl, pentylphenyl, hexylphenyl, heptylphenyl, octylphenyl, nonylphenyl, decylphenyl, undecylphenyl, dodecylphenyl, phenylphenyl, benzylphenyl, phenyl-styrene, p-cumylphenyl and naphthyl.

Within the meaning of the present invention, the cycloalkyl groups and the cycloalkenyl groups include, non limitatively, the cyclopentyl, cyclohexyl, cycloheptyl, methylcyclopentyl, methylcyclohexyl, methylcycloheptyl, cyclopentenyl, cyclohexenyl, cycloheptenyl, methylcyclopentenyl, methylcyclohexenyl groups. The cycloalkyl groups and the cycloalkenyl groups can comprise from 3 to 24 carbon atoms.

Advantageously, $R_1$, $R_2$, $R_3$ and $R_4$, identical or different, independently represent an alkyl group comprising from 4 to 18 carbon atoms or an alkenyl group comprising from 2 to 24 carbon atoms. In an embodiment, $X_1$, $X_2$, $X_3$ and $X_4$ can be identical and can represent a sulphur atom. In an embodiment, $X_1$, $X_2$, $X_3$ and $X_4$ can be identical and can be an oxygen atom. In an embodiment, $X_1$ and $X_2$ can represent a sulphur atom and $X_3$ and $X_4$ can represent an oxygen atom. In an embodiment, $X_1$ and $X_2$ can represent an oxygen atom and $X_3$ and $X_4$ can represent a sulphur atom. In an embodiment; the ratio of the number of sulphur atoms to the number of oxygen atoms (S/O) of the Mo-DTC compound can vary from (1/3) to (3/1).

In an embodiment, Mo-DTC compound of formula (A) can be chosen from at least one symmetrical Mo-DTC compound, at least one asymmetrical Mo-DTC compound and the combination thereof. By symmetrical Mo-DTC compound, is meant an Mo-DTC compound of formula (A) in which the $R_1$, $R_2$, $R_3$ and $R_4$ groups are identical. By asymmetrical Mo-DTC compound, is meant an Mo-DTC compound of formula (A) in which the $R_1$ and $R_2$ groups are identical, the $R_3$ and $R_4$ groups are identical and the $R_1$ and $R_2$ groups are different from the $R_3$ and $R_4$ groups. Advantageously, the Mo-DTC compound is a mixture of at least one symmetrical Mo-DTC compound and at least one asymmetrical Mo-DTC compound.

In an embodiment of the invention, identical $R_1$ and $R_2$, represent an alkyl group comprising from 5 to 15 carbon atoms and identical $R_3$ and $R_4$, different from $R_1$ and $R_2$, represent an alkyl group comprising from 5 to 15 carbon atoms. In a preferred embodiment, identical $R_1$ and $R_2$, represent an alkyl group comprising from 6 to 10 carbon atoms and $R_3$ and $R_4$ represent an alkyl group comprising from 10 to 15 carbon atoms. In another preferred embodiment, identical $R_1$ and $R_2$, represent an alkyl group comprising from 10 to 15 carbon atoms and $R_3$ and $R_4$ represent an alkyl group comprising from 6 to 10 carbon atoms. In another preferred embodiment, identical $R_1$, $R_2$, $R_3$ and $R_4$ represent an alkyl group comprising from 5 to 15 carbon atoms, preferably 8 to 13 carbon atoms.

Advantageously, the Mo-DTC compound is chosen from the compounds of formula A in which:

$X_1$ and $X_2$ represent an oxygen atom, $X_3$ and $X_4$ represent a sulphur atom, $R_1$ represents an alkyl group comprising 8 carbon atoms or an alkyl group comprising 13 carbon atoms, $R_2$ represents an alkyl group comprising 8 carbon atoms or an alkyl group comprising 13 carbon atoms, $R_3$ represents an alkyl group comprising 8 carbon atoms or an alkyl group comprising 13 carbon atoms, $R_4$ represents an alkyl group comprising 8 carbon atoms or an alkyl group comprising 13 carbon atoms.

Thus, advantageously, the Mo-DTC compound is chosen from the compounds of formula (A1):

(A1)

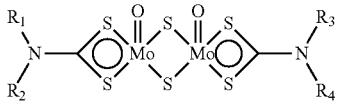

in which the $R_1$, $R_2$, $R_3$ and $R_4$ groups are as defined for formula (A).

Advantageously, the Mo-DTC compound is a mixture of:

an Mo-DTC compound of formula (A1) in which $R_1$, $R_2$, $R_3$ and $R_4$ represent an alkyl group comprising 8 carbon atoms, an Mo-DTC compound of formula (A1) in which $R_1$, $R_2$, $R_3$ and $R_4$ represent an alkyl group comprising 13 carbon atoms, and an Mo-DTC compound of formula (A1) in which $R_1$, $R_2$ represent an alkyl group comprising 13 carbon atoms and $R_3$ and $R_4$ represent an alkyl group comprising 8 carbon atoms, and/or an Mo-DTC compound of formula (A1) in which $R_1$, $R_2$ represent an alkyl group comprising 8 carbon atoms and $R_3$ and $R_4$ represent an alkyl group comprising 13 carbon atoms.

As examples of Mo-DTC compounds, the products Molyvan L, Molyvan 807 or Molyvan 822 marketed by R.T Vanderbilt Company or the products Sakura-lube 200, Sakura-lube 165, Sakura-lube 525 or Sakura-lube 600 marketed by Adeka can be mentioned. The Mo-DTC compound used in the compositions of the invention makes it possible in particular to reduce the coefficient of friction in limit and mixed lubrication conditions. Without being bound by a particular theory, this compound is adsorbed on the metal surfaces in order to form an antifriction film with low shear strength.

In an embodiment of the invention, the quantity of molybdenum provided by the Mo-DTC compound(s) in the composition can be greater than or equal to 500 ppm and can be less than or equal to 800 ppm, preferably less than or equal to 700 ppm, more preferentially less than or equal to 600 ppm by mass with respect to the total mass of the lubricant composition. The quantity of molybdenum provided by the Mo-DTC compound(s) to the lubricant composition can be measured using the ISO NFT 60106 method.

Molybdenum Dithiophosphate Compound

Molybdenum dithiophosphate (Mo-DTP) compounds are complexes formed by a metal nucleus bonded to one or more ligands, the ligand being an alkyl dithiophosphate group. These compounds are well known to a person skilled in the art.

In an embodiment, the Mo-DTP compound used in the compositions according to the invention can comprise from 1 to 40%, preferably from 2 to 30%, more preferentially from 3 to 28%, yet more preferentially from 4 to 15%, advantageously from 5 to 12% by mass of molybdenum, with respect to the total mass of the Mo-DTP compound. In an embodiment, the Mo-DTP compound used in the compositions according to the invention can comprise from 1 to 40%, preferably from 2 to 30%, more preferentially from 3 to 28%, yet more preferentially from 4 to 15% by mass of sulphur, with respect to the total mass of the Mo-DTP compound. In an embodiment, the Mo-DTP compound used in the compositions according to the invention can comprise from 1 to 10%, preferably from 2 to 8%, more preferentially from 3 to 6% by mass of phosphorus, with respect to the total mass of the Mo-DTP compound. The Mo-DTP compound used in the present invention can be chosen from the compounds the structure of which comprises two molybdenum atoms (also called dimeric Mo-DTP) and those the structure of which comprises three molybdenum atoms (also called trimeric Mo-DTP).

The trimeric Mo-DTP compound corresponds to the following $Mo_3S_kL_n$ formula in which:

k represents an integer at least equal to 4, preferably from 4 to 10, advantageously from 4 to 7, n represents an integer ranging from 1 to 4, and L represents an alkyl dithiophosphate group comprising from 1 to 100 carbon atoms, preferably from 1 to 40 carbon atoms, advantageously from 3 to 20 carbon atoms.

As examples of trimeric Mo-DTP compounds according to the invention, the compounds and the preparation processes thereof as described in the documents WO 98/26030 and US 2003/022954 can be mentioned. Advantageously, the Mo-DTP compound used within the context of the invention is a dimeric Mo-DTP compound. As examples of dimeric Mo-DTP compounds, the compounds as described in the documents EP 0 757 093 or EP 0 743 354 can be mentioned.

The dimeric Mo-DTCs generally correspond to the compounds of formula (B):

(B)

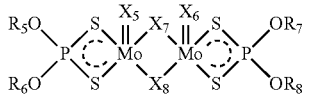

in which:

$R_5$, $R_6$, $R_7$ and $R_8$, identical or different, independently represent a hydrocarbon-containing group chosen from the alkyl, alkenyl, aryl, cycloalkyl or cycloalkenyl groups, $X_5$, $X_6$, $X_7$ and $X_8$, identical or different, independently represent an oxygen atom or a sulphur atom.

In an embodiment, $R_5$, $R_6$, $R_7$ and $R_8$, identical or different, independently represent an alkyl group comprising from 4 to 18 carbon atoms or an alkenyl group comprising from 2 to 24 carbon atoms. In an embodiment, $X_5$, $X_6$, $X_7$ and $X_8$ can be identical and can represent a sulphur atom. In another embodiment, $X_5$, $X_6$, $X_7$ and $X_8$ can be identical and can represent an oxygen atom. In another embodiment, $X_5$ and $X_6$ can represent a sulphur atom and $X_7$ and $X_8$ can represent an oxygen atom.

In another embodiment, $X_5$ and $X_6$ can represent an oxygen atom and $X_7$ and $X_8$ can represent a sulphur atom.

In a preferred embodiment of the invention, the Mo-DTP compound is chosen from the compounds of formula (B) in which:

$X_5$ and $X_6$ represent an oxygen atom, $X_7$ and $X_8$ represent a sulphur atom, $R_5$ represents an alkyl group comprising from 4 to 12 carbon atoms, preferably from 6 to 10 carbon atoms, $R_6$ represents an alkyl group comprising from 4 to 12 carbon atoms, preferably from 6 to 10 carbon atoms, $R_7$ represents an alkyl group comprising from 4 to 12 carbon atoms, preferably from 6 to 10 carbon atoms, $R_8$ represents an alkyl group comprising from 4 to 12 carbon atoms, preferably from 6 to 10 carbon atoms.

Advantageously, the Mo-DTP compound is chosen from the compounds of formula (B) in which:

$X_5$ and $X_6$ represent an oxygen atom, $X_7$ and $X_8$ represent a sulphur atom, $R_5$ represents an ethylhexyl group, $R_6$ represents an ethylhexyl group, $R_7$ represents an ethylhexyl group, $R_8$ represents an ethylhexyl group.

Advantageously, the Mo-DTP compound is chosen from the compounds of formula (B1):

(B1)

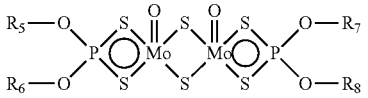

in which $R_5$, $R_6$, $R_7$ and $R_8$ are as defined for formula (B).

As examples of Mo-DTP compounds, the product Molyvan L marketed by R.T Vanderbilt Company or the products Sakura-lube 300 or Sakura-lube 310G marketed by Adeka can be mentioned. In an embodiment, the quantity of molybdenum provided by the Mo-DTC compound and by the Mo-DTP compound is at least 1100 ppm, preferably at least 1200 ppm, preferably at least 1300 ppm, preferably at least 1400 ppm, preferably at least 1500 ppm by mass with respect to the total mass of the lubricant composition. Advantageously, the quantity of molybdenum provided by the Mo-DTC compound and by the Mo-DTP compound ranges from 1000 ppm to 2500 ppm, preferably, from 1100 ppm to 2000, more preferentially from 1200 ppm to 1800 ppm, yet more preferentially from 1300 ppm to 1500 ppm, with respect to the total mass of the lubricant composition.

The Mo-DTP compound used in the compositions of the invention in combination with the Mo-DTC compound makes it possible in particular to obtain lubricant compositions having good storage properties and simultaneously maintaining or improving its fuel saving properties. Advantageously, the Mo-DTP compound makes it possible to solubilize the Mo-DTC compound in lubricant compositions having a high molybdenum content.

The quantity of molybdenum provided by the Mo-DTP compound(s) in the lubricant composition can be measured using the ISO NFT 60106 method. The total quantity of molybdenum in the lubricant composition is at least 1000 ppm with respect to the total mass of the lubricant composition, preferably from 1000 to 2000 ppm, advantageously from 1400 to 2000 ppm. The total quantity of molybdenum in the lubricant composition is measured according to the ISO NFT 60106 method.

The difference between the total quantity of molybdenum in the lubricant composition and the quantity of molybdenum provided by the Mo-DTC compound and the Mo-DTP compound can originate from other compounds comprising molybdenum and present in the lubricant composition. As examples of compounds comprising molybdenum other than the Mo-DTC and Mo-DTP compounds according to the invention, the compounds described in the document EP 2 078 745 can be mentioned. As a particular example of compounds comprising molybdenum other that the Mo-DTC and Mo-DTP compounds according to the invention, the molybdenum-based succinimide complexes can be mentioned.

Base Oils

The lubricant composition according to the present invention comprises at least one base oil which can be chosen from the base oils of Groups I to V as defined in the API (American Petroleum Institute) classification or its European equivalent: the ATIEL (Association Technique de l'Industrie Européenne des Lubricants) classification or mixtures thereof. The base oil or the mixture of base oils can be of natural or synthetic origin. The base oil or the mixture of base oils can represent at least 50%, preferably at least 60%, more preferentially at least 70%, yet more preferentially at least 80%, with respect to the total mass of the lubricant composition.

The table below describes the groups of base oils according to the API classification (Publication API No. 1509 Engine Oil Licensing and Certification System appendix E, 14th Edition, December 1996).

| | Saturated hydrocarbon content | Sulphur content | Viscosity index (VI) |
|---|---|---|---|
| Group I Mineral oils | <90% | >0.03% | 80 ≤ VI < 120 |
| Group II Hydrocracked oils | ≥90% | ≤0.03% | 80 ≤ VI < 120 |
| Group III Hydrocracked or hydroisomerized oils | ≥90% | ≤0.03% | ≥120 |
| Group IV | (PAO) Polyalphaolefins | | |
| Group V | Esters and other bases not included in bases of Groups I to IV | | |

The oils of Groups I to V can be oils of vegetable, animal, or mineral origin. The base oils referred to as mineral include all types of bases obtained by atmospheric and vacuum distillation of crude oil, followed by refining operations such as solvent extraction, deasphalting, solvent dewaxing, hydrotreating, hydrocracking and hydroisomerization, hydrofinishing. The base oil of the composition according to the present invention can be a synthetic oil, such as certain esters of carboxylic acids and alcohols, or polyalphaolefins. The polyalphaolefins used as base oil, which are distinguished from the heavy polyalphaolefins that can also be present in the compositions according to the invention, can for example be obtained from monomers having 4 to 32 carbon atoms (for example octene, decene), and have a viscosity at 100° C. ranging from 1.5 to 15 cSt (measured according to the international standard ASTM D445). Mixtures of synthetic and mineral oils can also be used.

Advantageously, the composition according to the invention is formulated to obtain a kinematic viscosity at 100° C. (KV100) ranging from 4 to 25 cSt, preferably from 5 to 22 cSt, more preferentially from 5 to 13 cSt measured according to the international standard ASTM D445. Advantageously, the composition according to the invention is formulated to have a viscosity index VI greater than or equal to 140, preferentially greater than or equal to 150, more preferentially greater than or equal to 160.

A subject of the invention is also an oil, preferentially an engine oil comprising a lubricant composition according to the invention. All the characteristics and preferences presented for the lubricant composition also apply to the oil according to the invention. In an embodiment, the oil according to the invention can be of 0W-20 and 5W-30 grade according to the SAEJ300 classification, characterized by a kinematic viscosity at 100° C. (KV100) ranging from 5.6 to 12.5 cSt measured according to the international standard ASTM D445. In another embodiment, the oil according to the invention can be characterized by a viscosity index, measured according to the international standard ASTM D2230, greater than or equal to 130, preferably greater than or equal to 150, more preferentially greater than or equal to 160. In order to formulate an engine oil, base oils having a sulphur content of less than 0.3%, for example mineral oils of Group III, and sulphur-free synthetic bases, preferentially of Group IV, or a mixture thereof can advantageously be used.

Other Additives

According to an embodiment, the lubricant composition according to the invention can moreover comprise at least one additive. The additive can be chosen from the group formed by anti-wear additives, extreme-pressure additives, antioxidants, overbased or non-overbased detergents, polymers improving the viscosity index, pour point improvers, dispersants, anti-foaming agents, thickeners and mixtures thereof. The additive(s) can be introduced alone and/or included in additive packages. The addition of the chosen additive(s) depends on the use of the lubricant composition. These additives and their use depending on the purpose of the lubricant composition are well known to a person skilled in the art.

In an embodiment of the invention, the additive(s) are suitable for use as engine oil. In an embodiment, the lubricant composition can comprise moreover at least one anti-wear additive, at least one extreme-pressure additive or a mixture thereof. The anti-wear and extreme-pressure additives protect the friction surfaces by the formation of a protective film adsorbed on these surfaces. A great variety of anti-wear additives exist, but the category most used in lubricant compositions, in particular for engine oil, is that of the phosphorus- and sulphur-containing additives such as the metallic alkylthiophosphates, in particular the zinc alkylthiophosphates, and more specifically the zinc dialkyldithiophosphates or ZnDTP. The preferred compounds are of formula $Zn((SP(S)(OR_9)(OR_{10}))_2$, where $R_9$ and $R_{10}$, identical or different, independently represent an alkyl group, preferentially containing from 1 to 18 carbon atoms. The amine phosphates are also anti-wear additives which can be used in the lubricant compositions according to the invention. However, the phosphorus provided by these additives acts as a poison on the catalytic systems of automobiles as these additives generate ashes. These effects can be minimized by partially substituting the amine phosphates with additives which do not provide phosphorus, such as, for example, the polysulphides, in particular the sulphur-containing olefins.

In an embodiment, in particular for an engine application, the anti-wear and extreme-pressure additives can be present in the oil at levels ranging from 0.01 to 6% by mass, preferentially from 0.05 to 4%, preferentially from 0.1% to 2% with respect to the total mass of the oil.

In an embodiment of the invention, the lubricant composition can comprise, moreover, at least one additional friction modifier. The additional friction modifier additive can be a compound providing metal elements or an ash-free compound. Among the compounds providing metal elements, there can be mentioned the transition metal complexes such as Mo (other than an Mo-DTC compound or an Mo-DTP compound), Sb, Sn, Fe, Cu, Zn, the ligands of which can be hydrocarbon-containing compounds containing oxygen, nitrogen, sulphur or phosphorus atoms. The ash-free friction modifiers are of organic origin and can be chosen from the monoesters of fatty acids and polyols, alkoxylated amines, alkoxylated fatty amines, fatty epoxides, borated fatty epoxides; fatty amines or glycerol esters of fatty acids. By "fatty" is meant within the meaning of the present invention a hydrocarbon-containing group comprising from 10 to 24 carbon atoms.

In an embodiment, the additional friction modifier additive can be present at levels ranging from 0.01 to 2% by mass, preferentially from 0.1 to 1.5% in the lubricant composition, with respect to the total mass of the lubricant composition. In an embodiment for an engine application, the additional friction modifier additive can be present in the engine oil at levels ranging from 0.01 to 5% by mass, preferentially from 0.1 to 2% in engine oils, with respect to the total mass of the engine oil.

In an embodiment, the lubricant composition can comprise, moreover, at least one antioxidant additive. The antioxidant additives slow down the degradation of the oils in service, degradation which can in particular result in the formation of deposits, the presence of sludges, or an increase in the viscosity of the oil. The antioxidant additives act in particular as radical inhibitors or hydroperoxide destroyers. Among the antioxidants commonly used, antioxidants of the phenolic or amine type can be mentioned. Some of these additives, for example the phosphorus- and sulphur-containing additives, may generate ashes. The phenolic antioxidants may be ash-free, or be in the form of neutral or basic metallic salts. Typically, these are the compounds containing a sterically hindered hydroxyl group, for example when two hydroxyl groups are in ortho or para position with respect to one another, or the phenol is substituted by an alkyl group containing at least 6 carbon atoms. The amine compounds are another class of antioxidants which can be used, optionally in combination with the phenolic antioxidants. Typical examples are the aromatic amines of formula $R_{11}R_{12}R_{13}N$, in which $R_{11}$ represents an aliphatic group or an optionally substituted aromatic group, $R_{12}$ represents an optionally substituted aromatic group, $R_{13}$ represents a hydrogen atom, an alkyl group, an aryl group or a group of formula $R_{14}S(O)_xR_{15}$, where $R_{14}$ represents an alkylene group or an alkenylene group, $R_{12}$ represents an alkyl group, an alkenyl group or an aryl group and x represents an integer equal to 0, 1 or 2. Sulphurized alkyl phenols or their alkali or alkaline-earth metal salts can also be used as antioxidants. Another class of antioxidants is that of the copper-containing compounds soluble in oil, for example the copper thio- or dithiophosphates, salts of copper and of carboxylic acids, dithiocarbamates, sulphonates, phenates, copper acetylacetonates. Copper I and II salts of succinic acid or anhydride can also be used.

The lubricant composition according to the invention can contain all types of antioxidant additives known to a person skilled in the art. Advantageously, ash-free antioxidants are used. In an embodiment, the lubricant composition according to the invention can comprise from 0.5 to 2% of at least one antioxidant additive by weight with respect to the total mass of the lubricant composition.

In an embodiment, the lubricant composition according to the invention can also comprise a detergent additive. Detergent additives reduce in particular the formation of deposits on the surface of the metal parts by dissolving the by-products of oxidation and combustion. The detergents that can be used in the lubricant composition according to the invention are well known to a person skilled in the art. The detergents commonly used in the formulation of lubricant compositions can be anionic compounds comprising a long lipophilic hydrocarbon-containing chain and a hydrophilic head. The associated cation is typically a metal cation of an alkali or alkaline-earth metal. The detergents are preferentially chosen from the alkali or alkaline-earth metal salts of carboxylic acids, sulphonates, salicylates, naphthenates, as well as the salts of phenates. The alkali or alkaline-earth metals are preferentially calcium, magnesium, sodium or barium. These metal salts can contain the metal in an approximately stoichiometric quantity or in excess (in a quantity greater than the stoichiometric quantity). In the latter case, these detergents are referred to as overbased detergents. The excess metal providing the detergent with its overbased character is present in the form of metal salts which are insoluble in oil, for example carbonate, hydroxide, oxalate, acetate, glutamate, preferentially carbonate.

In an embodiment, the lubricant composition according to the invention can comprise from 2 to 4% by weight of detergent, with respect to the total mass of the lubricant composition.

In an embodiment, the lubricant composition can comprise moreover at least one polymer improving the viscosity index. Polymers improving the viscosity index make it possible in particular to guarantee a good low temperature performance and a minimal viscosity at high temperature, in order to formulate multigrade oils in particular. Among these compounds the polymer esters, the olefin copolymers (OCP), the homopolymers or copolymers of styrene, butadiene or isoprene, hydrogenated or not hydrogenated, and the polymethacrylates (PMA) can be mentioned.

In an embodiment, the lubricant composition according to the invention can comprise from 1 to 15% by mass of polymers improving the viscosity index, with respect to the total mass of the lubricant composition. In an embodiment for an engine application, the engine oil according to the invention comprises from 0.1 to 10% by mass of polymers improving the viscosity index, with respect to the total mass of the engine oil, preferably from 0.5 to 5%, preferentially from 1 to 2%.

In an embodiment, the lubricant composition according to the invention can comprise moreover at least one pour point depressant additive. Pour point depressant additives in particular improve the low-temperature behaviour of the oils, by slowing down the formation of paraffin crystals. As examples of pour point depressant additives, the alkyl polymethacrylates, polyacrylates, polyarylamides, polyalkylphenols, polyalkylnaphthalenes, alkylated polystyrenes can be mentioned.

In an embodiment, the lubricant composition according to the invention can comprise, moreover, at least one dispersant additive. The dispersants ensure in particular the maintenance in suspension and the removal of the insoluble solid contaminants constituted by the oxidation by-products which form when a lubricant composition is in service. The dispersant additives can be chosen from the groups formed by the succinimides, the PIB (polyisobutene) succinimides, the Mannich bases.

In an embodiment, the lubricant composition according to the invention can comprise from 5 to 8% by mass of dispersants, with respect to the total mass of the lubricant composition.

The Parts

The lubricant composition according to the invention can lubricate at least one mechanical part or one mechanical unit, in particular bearings, gears, universal joints, transmissions, the pistons/rings/liners system, camshafts, clutch, manual or automatic gearboxes, rocker arms, crankcases etc. A subject of the invention is also a method for reducing the energy losses by friction of a mechanical part, said method comprising at least one step of bringing a mechanical part into contact with a lubricant composition according to the invention. All the characteristics and preferences presented for the lubricant composition also apply to the method for reducing the energy losses by friction of a mechanical part according to the invention.

A subject of the invention is also a method for reducing the fuel consumption of a vehicle, the method comprising at least one step of bringing a lubricant composition according to the invention into contact with at least one mechanical part of the engine of the vehicle. All the characteristics and preferences presented for the lubricant composition also apply to the method for reducing for reducing the fuel consumption of a vehicle according to the invention. A subject of the invention is also the use of a lubricant composition according to the invention for reducing the fuel consumption of vehicles. All the characteristics and preferences presented for the lubricant composition also apply to the use for reducing the fuel consumption of vehicles according to the invention. The vehicles can comprise a two- or four-stroke internal combustion engine.

The engines can be gasoline engines or diesel engines intended to be supplied with standard gasoline or diesel. By "standard gasoline" or by "standard diesel" is meant within the meaning of the present invention engines which are supplied with a fuel obtained after refining an oil of mineral origin (such as petroleum for example). The engines can also be gasoline engines or diesel engines modified to be supplied with a fuel based on oils originating from renewable materials such as fuels based on alcohol or biodiesel fuel. The vehicles can be light vehicles such as automobiles, motorcycles, lorries, construction machinery, vessels.

A subject of the invention is also the use of a lubricant composition according to the invention for reducing the energy losses by friction of a metal part, preferentially in the bearings, gears or universal joints. All the characteristics and preferences presented for the lubricant composition also apply to the use for reducing the energy losses by friction of a metal part according to the invention.

The different subjects of the present invention and their implementations will be better understood on reading the examples which follow. These examples are given by way of indication, without being limitative.

EXAMPLES

The lubricant compositions A and B (comparative) and the lubricant compositions C, D and E (according to the invention) were prepared from the following constituents:

a base oil of Group III having a kinematic viscosity at 100° C. (KV100) equal to 4.18 cSt (measured according to the international standard ASTM D445), a polymer improving the viscosity index which is a hydrogen-containing styrene/isoprene star polymer (SV) from the Shellvis® range from Shell, a polymer improving the viscosity index which is a polymethacrylate (PMA), marketed under the name Viscoplex 3-200 by Evonik RohMax, an additive package comprising a mixture of carboxylate/sulphonate detergents, a dispersant of PIB succinimide type, an anti-wear additive of ZnDTP type and an antioxidant of diphenylamine type (marketed under the name Irganox L57 by Chemtura), a molybdenum dithiocarbamate compound comprising 10% by mass of Mo marketed by Adeka under the name Sakura-lube 525.

a molybdenum dithiophosphate compound comprising 9% by mass of Mo marketed by Adeka under the name Sakura-lube 300.

The percentages by mass of the different constituents of the lubricant compositions tested are given in Table I below.

TABLE I

| | A (comparative) | B (comparative) | C (invention) | D (invention) | E (invention) |
|---|---|---|---|---|---|
| Base oil | 82.57 | 81.87 | 81.76 | 81.79 | 81.17 |
| Additive package | 9.33 | 9.33 | 9.33 | 9.33 | 9.33 |
| PMA | 5.5 | 5.5 | 5.5 | 5.5 | 5.5 |
| SV | 1.8 | 1.8 | 1.8 | 1.8 | 1.8 |
| MoDTC | 0.8 | 1.5 | 0.5 | 0.7 | 0.7 |
| MoDTP | — | — | 1.11 | 0.88 | 1.5 |
| Total | 100 | 100 | 100 | 100 | 100 |
| Total quantity of Mo measured in the composition (ppm) | 850 | 1500 | 1500 | 1500 | 2000 |

Stability Test:

A hermetically-sealed glass flask comprising 100 g of the lubricant composition to be tested was placed in a refrigerator at a temperature of 0° C. After a period of one week, the visual appearance of the lubricant composition was observed. It was considered that the composition was stable if it remained clear and no deposit was formed at the bottom of the flask. It was considered that the lubricant composition was not stable if it was cloudy and/or if deposits formed at the bottom of the flask.

The results are shown in Table II below.

TABLE II

| | Composition | Stability |
|---|---|---|
| 850 ppm Mo (MoDTC) | A | Yes |
| 1500 ppm Mo (MoDTC) | B | No |
| 1500 ppm Mo (500 ppm MoDTC/1000 ppm MoDTP) | C | Yes |
| 1500 ppm Mo (700 ppm MoDTC/800 ppm MoDTP) | D | Yes |
| 2000 ppm Mo (700 ppm MoDTC/1300 ppm MoDTP) | E | Yes |

The results show the compositions according to the invention have good stability.

Fuel Economy Test

This test was based on the use of a driven engine test bench. A 3L V6 petrol engine test bench is driven with:

a range of engine oil and water temperature of 50° C. and 80° C. representative of the following target homologation cycles: NEDC (corresponding to the European measurement cycle of reference for pollutant emissions and JC08 (corresponding to the Japanese measurement cycle of reference for pollutant emissions), a range of engine speed from 500 rpm to 3000 rpm representative of the target homologation cycles: NEDC and JC08.

This test includes comparison with a reference oil in order to monitor any possible bias in the test means and in order to assess a level of saving with respect to the reference oil. The reference oil was a commercial 0W20 ILSAC GF4 oil recommended by the manufacturer for use in this engine.

The friction savings are expressed in Table III as the average at 50° C. and 80° C. of the friction savings with respect to the reference oil over the defined ranges of operating conditions. It was established that a difference of 0.4% between two compositions makes it possible to significantly distinguish the fuel economy properties of these compositions.

TABLE III

| Composition | Mo (ppm) | Idling 550/800 rpm | Low speed 800/1600 rpm | High speed 1600/2400 rpm | Stability |
|---|---|---|---|---|---|
| A | 850 ppm Mo (MoDTC) | 0.0% (Ref) | 0.0% (Ref) | 0.0% (Ref) | Yes |
| B | 1500 ppm Mo (MoDTC) | 1.9% | 1.1% | 0.7% | No |
| C | 1500 ppm Mo (MoDTC/MoDTP) | 3.9% | 1.9% | 0.9% | Yes |

The results show that the lubricant composition according to the invention has both good stability properties as well as good fuel economy properties. It should be noted that these fuel savings are obtained when the engine turns at idling speed, i.e. between 550 and 800 revolutions per minute (rpm) at 80° C. but also when the engine turns at high speed i.e. between 1600 and 2400 revolutions per minute (rpm) at 80° C.

The invention claimed is:

1. A method for obtaining a lubricant composition with a high molybdenum content, the method comprising adding at least one molybdenum dithiocarbamate compound and at least one molybdenum dithiophosphate compound in a base oil so that:

the quantity of molybdenum provided by the molybdenum dithiophosphate compound and by the molybdenum dithiocarbamate compound ranges from 1000 to 2500 ppm by mass with respect to a total mass of the lubricant composition; and the quantity of molybdenum provided by the molybdenum dithiocarbamate compound ranges from 500 to 800 ppm by mass with respect to the total mass of the lubricant composition, wherein the molybdenum dithiocarbamate compound and the molybdenum dithiophosphate compound are the sole sources of molybdenum in the lubricant composition, and wherein the lubricant composition has an improved storage stability relative to a second lubricant composition having corresponding components and concentrations, including the same total amount of molybdenum, except with a quantity of the total amount of molybdenum provided by a molybdenum dithiocarbamate compound being greater than 900 ppm by mass with respect to the total mass of the second lubricant composition and a quantity of the total amount of molybdenum provided by a molybdenum dithiophosphate compound being decreased by an amount equivalent to the quantity of the total amount of molybdenum provided by the molybdenum dithiocarbamate that is more than 900 ppm.

2. The method according to claim 1, in which the quantity of molybdenum provided by the molybdenum dithiophosphate compound and by the molybdenum dithiocarbamate compound ranges from 1100 to 2000 ppm by mass with respect to the total mass of the lubricant composition.

3. The method according to claim 1, in which the at least one molybdenum dithiocarbamate compound is of formula (A1):

(A1)

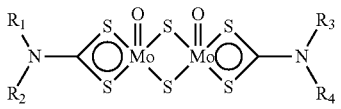

in which $R_1$, $R_2$, $R_3$, $R_4$, identical or different, independently represent an alkyl group containing 4 to 18 carbon atoms.

4. The method according to claim 3, in which the at least one molybdenum dithiocarbamate compound of formula (A1) is a symmetrical molybdenum dithiocarbamate in which the $R_1$, $R_2$, $R_3$ and $R_4$ groups are identical.

5. The method according to claim 3, in which the at least one molybdenum dithiocarbamate compound of formula (A1) is an asymmetrical molybdenum dithiocarbamate in which:

the $R_1$ and $R_2$ groups are identical;

the $R_3$ and $R_4$ groups are identical; and the $R_1$ and $R_2$ groups are different from the $R_3$ and $R_4$ groups.

6. The method according to claim 3, in which at least one molybdenum dithiocarbamate compound of formula (A1) is symmetrical and at least one molybdenum dithiocarbamate compound of formula (A1) is asymmetrical.

7. The method according to claim 1, in which the quantity of molybdenum provided by the molybdenum dithiocarbamate compound is greater than or equal to 500 ppm and less than or equal to 800 ppm by mass with respect to the total mass of the lubricant composition.

8. The method according to claim 1, in which the molybdenum dithiophosphate compound has as general formula the following formula (B1):

(B1)

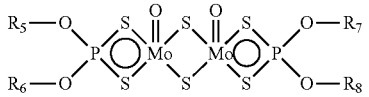

in which $R_5$, $R_6$, $R_7$, $R_8$, identical or different, independently represent an alkyl group comprising 4 to 18 carbon atoms.

9. The method according to claim 1, further comprising adding at least one additive chosen from detergents, anti-wear additives, extreme-pressure additives, antioxidants, polymers improving the viscosity index, pour point improvers, dispersants, anti-foaming agents, thickeners and mixtures thereof.

10. The method according to claim 1, in which the lubricant composition has a kinematic viscosity at 100° C. measured according to the standard ASTM D445 from 4 to 25 cSt.

11. The method according to claim 1, in which the lubricant composition has a viscosity index greater than or equal to 140.

12. A method for reducing energy losses by friction of a mechanical part, the method comprising putting the mechanical part into contact with a lubricant composition made by the method according to claim 1, wherein the lubricant composition is stored for a period of 1 week prior to the contacting.

13. A method for reducing fuel consumption of a vehicle, the method comprising putting a mechanical part of an engine of the vehicle into contact a lubricant composition made by the method according to claim 1, wherein the lubricant composition is stored for a period of 1 week prior to the contacting.

14. The method according to claim 2, in which the quantity of molybdenum provided by the molybdenum dithiophosphate compound and by the molybdenum dithiocarbamate compound ranges from 1200 to 1800 ppm by mass with respect to the total mass of the lubricant composition.

15. The method according to claim 2, in which the quantity of molybdenum provided by the molybdenum dithiophosphate compound and by the molybdenum dithiocarbamate compound ranges from 1300 to 1500 ppm by mass with respect to the total mass of the lubricant composition.

16. The method according to claim 7, in which the quantity of molybdenum provided by the molybdenum dithiocarbamate compound is greater than or equal to 500 ppm and less than or equal to 700 ppm by mass with respect to the total mass of the lubricant composition.

17. The method according to claim 7, in which the quantity of molybdenum provided by the molybdenum dithiocarbamate compound is greater than or equal to 500 ppm and less than or equal to 600 ppm by mass with respect to the total mass of the lubricant composition.

18. The method according to claim 10, in which the lubricant composition has a kinematic viscosity at 100° C. measured according to the standard ASTM D445 from 5 to 22 cSt.

19. The method according to claim 1, wherein the at least one molybdenum dithiocarbamate compound comprises from 4 to 15% by mass of molybdenum with respect to the total mass of the at least one molybdenum dithiocarbamate compound, and from 4 to 15% by mass of sulfur with respect to the total mass of the at least one molybdenum dithiocarbamate compound.

20. The method according to claim 1, wherein the at least one molybdenum dithiocarbamate compound comprises from 5 to 12% by mass of molylbdenum with respect to the total mass of the at least one molybdenum dithiocarbamate compound, from 4 to 15% by mass of sulfur with respect to the total mass of the at least one molybdenum dithiocarbamate compound, and from 3 to 6% by mass of phosphorus with respect to the total mass of the at least one molybdenum dithiocarbamate compound.

21. The method according to claim 1, wherein the lubricant composition comprises 500 ppm of the at least one molybdenum dithiocarbamate compound and 1000 ppm of the at least one molybdenum dithiophosphate compound.

22. The method according to claim 1, wherein the lubricant composition comprises 700 ppm of the at least one molybdenum dithiocarbamate compound and 800 ppm of the at least one molybdenum dithiophosphate compound.

23. The method according to claim 1, wherein the lubricant composition comprises 700 ppm of the at least one molybdenum dithiocarbamate compound and 1300 ppm of the at least one molybdenum dithiophosphate compound.

24. The method according to claim 1, wherein the lubricant composition has the improved storage stability relative to the second lubricant composition after being stored at 0° C. for 1 week.

* * * * *